United States Patent [19]

Colebrook

[11] Patent Number: 4,982,859

[45] Date of Patent: Jan. 8, 1991

[54] BASE FRAME STRUCTURE FOR CONTAINERS OR LOAD CARRYING PLATFORMS

[75] Inventor: David Colebrook, 19 Tangier Road, Guildford, Surrey, England

[73] Assignee: David Colebrook, Guildford, England

[21] Appl. No.: 303,663

[22] PCT Filed: Aug. 7, 1987

[86] PCT No.: PCT/GB87/00562

§ 371 Date: Jan. 23, 1989

§ 102(e) Date: Jan. 23, 1989

[87] PCT Pub. No.: WO88/00912

PCT Pub. Date: Feb. 11, 1988

[30] Foreign Application Priority Data

Aug. 8, 1986 [GB] United Kingdom ..... 8619400

[51] Int. Cl.[5] ..... B65D 90/02

[52] U.S. Cl. ..... 108/51.1; 220/630; 206/386; 220/1.5; 220/444

[58] Field of Search ..... 108/51.1, 55.1, 55.5, 108/521; 206/386, 599; 220/1.5, 69, 415, 444

[56] References Cited

U.S. PATENT DOCUMENTS

| | | | |
|---|---|---|---|
| 3,826,398 | 7/1974 | Rivers, Jr. | 108/51.1 |
| 3,968,895 | 7/1976 | Barnes, Jr. et al. | 206/599 |
| 4,782,973 | 11/1988 | Wiese | 220/444 |

FOREIGN PATENT DOCUMENTS

| | | | |
|---|---|---|---|
| 0284290 | 9/1988 | European Pat. Off. | 206/386 |
| 8202248 | 1/1984 | Netherlands | 206/386 |
| 0199950 | 6/1923 | United Kingdom . | |
| 0270638 | 7/1927 | United Kingdom . | |
| 2044728 | 10/1980 | United Kingdom . | |

*Primary Examiner*—Jimmy G. Foster

*Attorney, Agent, or Firm*—Ladas & Parry

[57] ABSTRACT

The base frame structure for containers or load carrying platforms has an outer rectangular frame structure with longitudinal side beams (13) and transverse beams extending between the side beams. Between the longitudinal side beams and transverse beams is mounted a dished sheet metal underpan, preferably welded to the side beams (13) and transverse beams. Sheet flooring material (4) such as sheet plywood or wooden planks are supported on the underpan and preferably fixed one to the other by adhesive bonding. A space (5) defined between the underpan and flooring material is filled with a rigid load distributing filling material (6) such as polyurethane foam having a high density, 60 $Kg/m^3$ for example. The underpan is curved in at least two directions to distribute load forces applied to the flooring. The underpan is of a reduced thickness resulting in a lighter base frame structure. The flooring element of underpan (3), flooring (4) and filler (6) can be manufactured separately and is readily installed and removed.

7 Claims, 2 Drawing Sheets

BASE FRAME STRUCTURE FOR CONTAINERS OR LOAD CARRYING PLATFORMS

Figure 1:
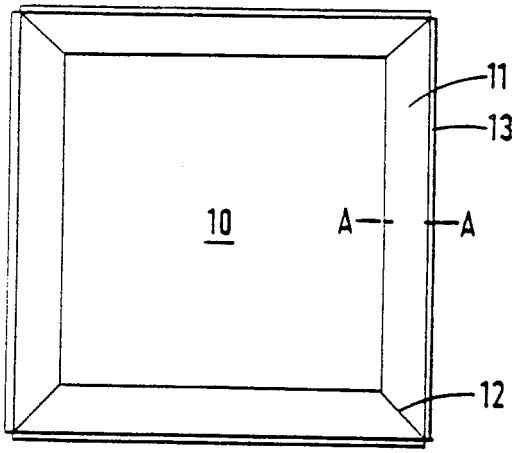

The present invention relates to base frame structure for containers, load carrying platforms, commonly known as flat racks or other like constructions which are movable from one transporting device to another and for storage purposes.

Conventional base structures of this type generally comprise a rectangular frame structure with longitudinal side beams and main transverse beams extending therebetween. Interspersed between the main transverse beams are a number of spaced transverse members each having a Z-shaped (or other shape) profile serving to support flooring which generally consists of sheet plywood or wood planks. These additional transverse members are closely spaced to ensure that the container floors are able to resist both the load of goods located thereon and also heavy point loads, such as that applied by the wheels of a forklift truck for example. When containers or flat racks are removed from a transporter and placed upon the ground it is not always easy to ensure that the ground has a perfectly flat surface and it is possible to position the container on the ground directly over odd pieces of brick, rubble or metal which can cause severe distortion of the intermediate transverse members, thus weakening the base flooring structure.

U.K. No. 954539-A discloses a container with a curved bottom portion which is part of the integral structure of the container and does not lie between transverse beams.

In U.K. No. 2044728-B there is described a base structure in which the close spaced Z-shaped (or other shape) profile members are omitted and downwardly curved sheet metal plates (hereinafter referred to as "underpans") which are curved in one direction and are secured between the main transverse beams below the flooring with the curved edge of the sheet material abutted and welded to respective oppositely disposed longitudinal frame beams. The usual sheet flooring is located across and is supported by the transverse beams and the space between the flooring panels and the downwardly curved sheet material is filled with a rigid filling such as wood chippings and adhesive which distributes the load applied to the portion of the floor between the transverse beams to the metal plates. The underpan is less subject to contact with rubble since it lies higher in the frame structure and is easy to paint and reduces corrosion.

However, such a construction has been found to be disadvantageous in that it is very heavy since the thickness of the one-way downwardly curved sheet material has to be sufficient to support not only the rigid filling material but also any load which is applied to the flooring. Typically the minimum thickness of the sheet metal underpan is 2 mm.

According to one aspect of the present invention there is provided a baseframe structure for containers or load carrying platforms characterised in that the dished sheet underpan is curved in at least two directions and that the flooring of sheet material is supported on the underpan.

Generally, the dished pan is one with sides higher than the major area of the central portion. The term curved for this disclosure includes a cross-section in which the sides and base are straight lines angled to each other to form a general dish shape.

In one preferred embodiment of a base frame structure according to the present invention the directions in which the underpan is curved are transverse to each other, preferably at right angles.

The underpan is preferably formed as a one piece stamping from a single sheet of metallic material. In another preferred form a single sheet of metal is shaped at the corners thereof such that when edge portions of the sheet are bent upwardly the shaped edges of one edge portion engage and are welded to the cut edges of the next adjacent edge portions.

Preferably, the extreme outer edge of each edge portion is provided with an outwardly extending flange for connecting the underpan to the transverse and longitudinal beams of the base frame structure.

Conveniently, sheets of the flooring material are sealingly abutted together and to the underpan. The flooring can be provided with holes therein through which a polyurethane or other rigid foam mixture can be pumped into the space between the underpan and the undersurface of the flooring. Some of the holes in the flooring are provided to allow air and eventually the foam material, when the space is filled to flow from said space, whereupon the foam injection is stopped. The outer flange around the edge of the sheet material is preferably arranged to contact and be fixed to, the longitudinal and transverse beams for example by welding. Conveniently the longitudinal side beams are of a generally C-shaped cross section and the transverse beams have an I-shaped cross-section.

In an alternative construction the longitudinal and transverse beams are of an I-shaped or other shaped cross section and the outer flange around the edge of the sheet metal member is bent downwardly and outwardly for contact with the upper surface of these members.

The plywood flooring is shaped so as to fit within the dished metal member with its top surface lying flush with the upper exposed surface of the outer flange of the underpan welded to the transverse member and consequently when installed substantially co-planar with the upper surface of the transverse beams. The plywood flooring is preferably bonded to the underpan with adhesive, although rivets or nuts and bolts can be provided to secure the plywood to the sheet metal member after bonding.

According to another aspect of the invention there is provided a floor element for a container or load carrying platforms locatable between transverse beams characterised in a base underpan curved in at least two directions and being mountable on upper surfaces of the transverse and longitudinal members of the container, a flooring mounted on and fixed relative to the periphery of the underpan, and a load distributing rigid filling material filling the space between the flooring and the underpan.

To support the underpan at least the transverse container beams can be configured to provide a sloped surface between the upper surface and the vertical face, on which angled underpan edge flanges can rest and be attached. The flooring sheeting can be shaped at the periphery on its lower surface to co-operate with the shaping of the periphery of the underpan.

In a modification the adjacent ends of floor elements could abut on top of the transverse beams, the flooring material within each element being therefore co-planar with the flooring material of other elements but not necessarily with the upper surface of the transverse beams.

Figure 2:
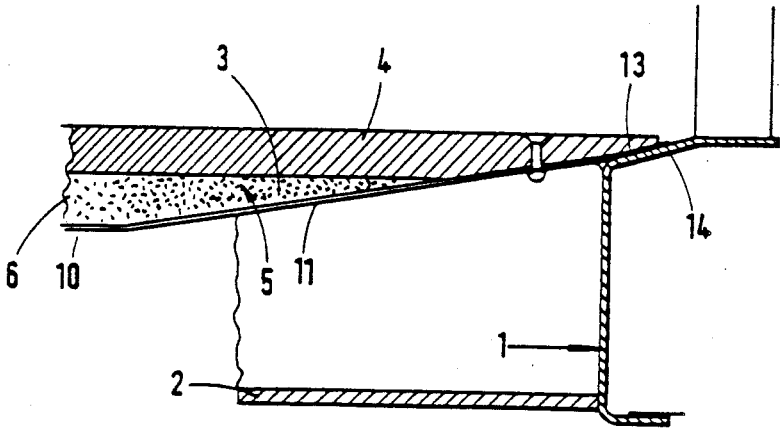
Figure 3:
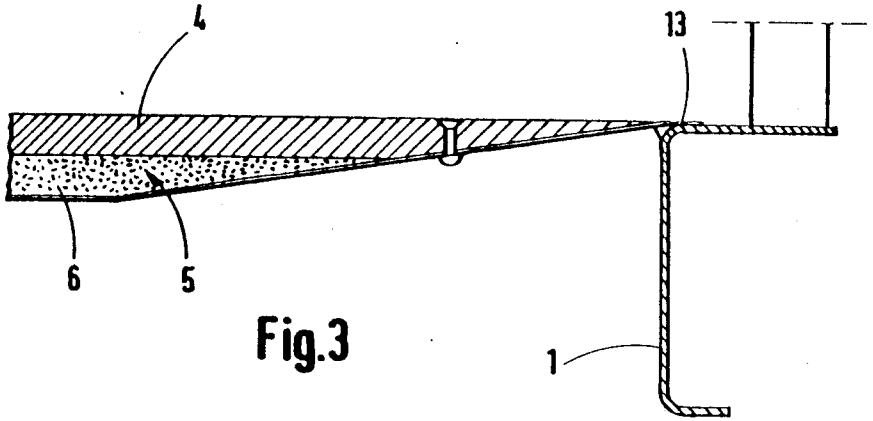
Figure 4:
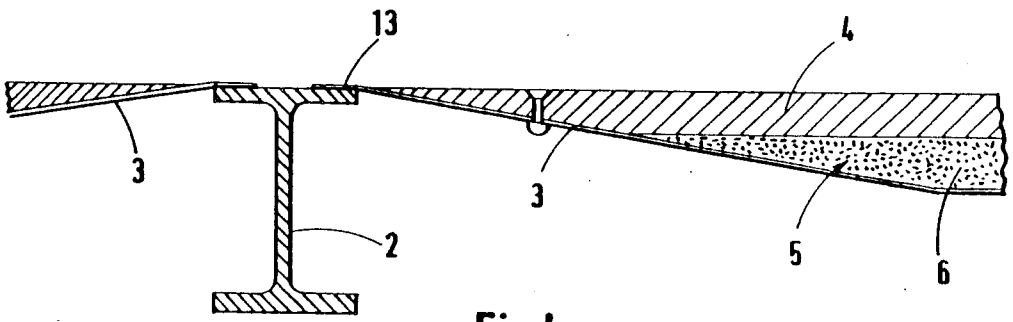

A preferred embodiment of a base frame structure according to the present invention will now be described by way of example with reference to the accompanying drawing in which:

FIG. 1 is a plan view of a shaped sheet metal underpan for use in the base frame structure according to the present invention, FIG. 2 is a cross sectional view of part of the underpan taken along the line A—A of FIG. 1, FIG. 3 is a sectional view through a longitudinal side rail or beam and modified form of underpan structure, and FIG. 4 is cross sectional view of part of a transverse beam of the base frame structure with an underpan attached to each side thereof.

Referring more specifically to the drawings, a base frame structure according to the present invention comprises two parallel longitudinal side members which are beams or rails 1 and transverse beams 2 to interconnect the longitudinal side rails at the extreme ends thereof and at selected locations along the length of the side rails.

A downwardly extending dished underpan 3 of sheet material is interposed between adjacent transverse beams and longitudinal side rail members. A sheet of plywood or other suitable flooring material 4 sits on the underpan 3 in the region of the edges thereof to define a space 5 between the flooring and the underpan, which space is filled with polyurethane foam 6, (or other filling material).

The underpan 3 shown in FIG. 1 and FIG. 2 is of a rectangular configuration and has a generally flat base portion 10 and outwardly and upwardly sloping portions 11 suitably shaped from a single sheet of metal material such as steel, so that when the portions 11 are curved upwardly the individual sloping portions 11 engage the next adjacent sloping portions along lines 12, whereupon the sloping portions 11 are interconnected, preferably by welding. An outer flange 13 is provided along the extreme outer edge of the portions 11 and this flange 13 is arranged to contact the side rails and transverse beams and is welded to these members so that the underpan 3 is supported on all its four sides. The flange 13 rests on a sloped surface 14 formed at the edge of each of the respective longitudinal and transverse beams.

Base portion 10 is of a generally flat configuration whilst the sloped portions 11 slope upwardly with a ratio of 6.25:1. The flanges 13 are arranged to have a different slope of 3.5:1. As previously indicated each flange 13 is welded along its free edge and along its underside to a respective one of the side rail 1 and transverse beam 2. A seal and filler sealant of hard rubber for example is provided along the welds to protect the same.

The plywood flooring preferably comprises two abutting sheets of plywood each having its under surface along the remaining three sides, shaped in the region of its edges to conform with the sloping of the portions 11 of the underpan. The plywood flooring is fixed to the underpan firstly by bonding with adhesive (not shown) and then, if necessary, by rivets or other suitable fixing devices. The polyurethane foam 6 which is pumped into the space 5 through holes (not shown) in the wood flooring 4 is preferably a high density polyurethane foam having a density of 60 $Kg/m^3$. Such a high density foam assists in distributing forces caused by a load applied to the underpan through the flooring. Higher or lower density foam can be used depending on the particular use for which the container or load carrying platform is designed. The pressure of the foam within the space 5 causes the base portions 10 and 11 to bow slightly.

Generally bonding of the flooring with the underpan assists in the transfer of tension forces between the shear connections at the junction of the flooring and underpan. Furthermore, the provision of curving of the underpan in transverse directions surprisingly has been found to spread the effect of forces applied thereto and thereby to considerably to reduce point loading on the underpan. Accordingly, a considerable reduction in thickness of the underpan is possible for a given load condition than was possible in the prior art. A reduction of 50% in the thickness of the underpan is possible with a resultant saving in weight. Typically the thickness of the underpan used with the base frame structure of the present invention is 1 mm.

The base frame structure of the present invention is also easy to paint and maintain to reduce corrosion whilst in presenting only a relatively small area at its lowermost point, the structure is less likely to be subjected to damage.

Since the underpan rests upon and is welded to the longitudinal and transverse members it is readily replaceable by cutting out around its edges. The surfaces of the longitudinal and transverse member are then cleaned and prepared and another underpan flooring unit is located within the space provided on the container and welded into position.

Therefore, there is provided a flooring unit which is lighter than other underpan floorings, is manufactured separately from the container with which it is used, and is easily replaceable without having to replace the whole of the container flooring thus considerably reducing the cost of maintenance and repair.

The flooring unit itself is manufactured by shaping a sheet of metal so that it is curved in two or more directions, placing the underpan on a mould to support the underpan, locating preformed sheet flooring members onto the underpan, sealing the sheet members together and bond them sealingly to the underpan. Rivets or nuts and bolts can be used to completely secure bonding of flooring to underpan. Polyurethane foam is then pumped through holes in the flooring until the foam exudes from other holes in the flooring whereupon the space between the flooring and underpan is filled.

The flooring unit is then located on top of the longitudinal and transverse beams and welded to them. A seal and filler sealant of hard rubber for example is provided along the welds to protect the same.

Referring now to the modified form of the underpan shown in FIGS. 3 and 4 the construction is substantially identical to that shown in FIG. 2, however, the outer flange 13 is not sloped but lies parallel to the flat bottom portion 10 to rest upon the rectangularly shaped longitudinal side rail or transverse beam. In this case the edge of the flooring will be within the inner edge of outer flange. In either case the upper surface of the flooring is substantially co-planar with the upper surface of the beam.

FIG. 4 illustrates the connection of two underpans 3 of the configuration shown in FIG. 3 to transverse member 2, with one underpan on either side thereof.

The attachment is made by welding as described above for the previously described embodiment.

Preferably, the depth between the upper surface of the sheet flooring 4 and the underpan is 40 mm with the plywood being 20 mm thick and the foam 20 mm thick. The sheet metal of the underpan is 1 mm thick, and is of muffler grade stainless steel.

The underpan is preferably of an elongate rectangular configuration being 2430 mm by 2489 mm. The flanges 13 are typically 27 mm wide whilst the sloping portions 11 are 250 mm wide. However, the underpan can be of any shape in which the bowing thereof is in two or more directions.

At least two of the transverse members or beams preferably take the form of an inverted generally rectangular U-shape or hollow box configuration which extend to the outside of the base frame for receiving the tines of, for example, a fort lift truck.

Whilst the foam filling has been described as having a density of 60 $Kg/m^3$, foam having a density of 100 $Kg/m^3$ or higher can be used.

I claim:

1. A flooring element for a container or load carrying platform characterised by an underpan curved in at least two directions, flooring means mounted on and fixed relative to the underpan with space defined therebetween, and polyurethane foam mixture having a density of at least 60 $kg/m^3$ located in and filling the said space between the flooring means and underpan, the flooring element being locatable on and attachable to the longitudinal and transverse beams of a base frame of the container.

2. An element as claimed in claim 1, characterised in that the sheet material flooring comprises sheets of plywood and is bonded to the underpan with adhesive.

3. An element as claimed in claim 2, characterised in that the sheet material flooring is chamfered on its under surface along its outer edges to lie on sloping surfaces of the outer edge portions of the dished underpan so that the top surface of the sheet flooring material is flush with the uppermost surface of the outer flange of the underpan.

4. A base frame structure for containers or load carrying platforms comprising a longitudinal frame structure having longitudinal side beams with transverse beams extending therebetween and a dished sheet underpan supported on the longitudinal and transverse beams of the base frame structure, a flooring of sheet material and a load distributing rigid filling material located in the space between the underpan and the under surface of the flooring material, characterised in that the sheet underpan is curved in at least two directions, that the flooring of sheet material is supported on the underpan, and that the load distributing rigid filling material is a polyurethane foam mixture, having a density of at least 60 $kg/m^3$.

5. A base frame structure for containers or load carrying platforms comprising a longitudinal frame structure having longitudinal side beams with transverse beams extending therebetween and a dished sheet under pan supported on the longitudinal and transverse beams of the base frame structure, a flooring of sheet material and a load distributing rigid filling material located in the space between the underpan and the under surface of the flooring material, characterised in that the sheet underpan is curved in at least two directions and that the flooring of sheet material is supported on the underpan, the underpan is a single sheet of metal of rectangular configuration and has edge portions of the sheet bent upwardly, opposite ends of each edge portion engaging respective ends of the next adjacent edge portions, and in that a flange extends outwardly from the extreme outer edge of each edge portion for connecting the underpan to transverse and longitudinal beams of the base frame structure, at least one pair of opposed flanges being arranged to rest on sloped portions of either the longitudinal or transverse beams.

6. A structure as claimed in claim 5, characterised in that the sheet material flooring is chamfered on its under surface along its outer edges to lie on sloping surfaces of the outer edge portions of the dished underpan so that the top surface of the sheet flooring material is flush with the uppermost surface of the outer flange of the underpan.

7. A structure as claimed in claim 6, characterised in that the sheet material flooring is bonded to the underpan with adhesive.

* * * * *

UNITED STATES PATENT AND TRADEMARK OFFICE

CERTIFICATE OF CORRECTION

PATENT NO. : 4,982,859

DATED : January 8, 1991

INVENTOR(S) : David Colebrook

It is certified that error appears in the above-identified patent and that said Letters Patent is hereby corrected as shown below:

Title page, item [73] Assignee: please delete "David Colebrook, Guildford, England" and substitute -- Sea Containers Ltd., London SE 1 England--.

Signed and Sealed this

Twenty-fifth Day of August, 1992

*Attest:*

DOUGLAS B. COMER

*Attesting Officer*

*Acting Commissioner of Patents and Trademarks*